US006036566A

United States Patent [19]

Baldi et al.

[11] Patent Number: 6,036,566

[45] Date of Patent: Mar. 14, 2000

[54] METHOD OF FABRICATING FLAT FED SCREENS

[75] Inventors: Livio Baldi, Agrate Brianza; Maria Santina Marangon, Cernusco Sul Naviglio, both of Italy

[73] Assignee: SGS-Thomson Microelectronics S.R.L., Agrate, Italy

[21] Appl. No.: 08/942,477

[22] Filed: Oct. 2, 1997

[30] Foreign Application Priority Data

Oct. 4, 1996 [EP] European Pat. Off. ..... 96830509

[51] Int. Cl.[7] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 4,857,161 | 8/1989 | Borel et al. | 204/192 |
| 5,315,206 | 5/1994 | Yoshida | 313/306 |
| 5,457,355 | 10/1995 | Fleming et al. | 313/336 |
| 5,714,837 | 2/1998 | Zurn et al. | 313/495 |
| 5,769,679 | 6/1998 | Park et al. | 445/50 |
| 5,865,659 | 2/1999 | Ludwig et al. | 445/50 |

FOREIGN PATENT DOCUMENTS

| | | | |
|---|---|---|---|
| WO 96/18206 | 6/1996 | WIPO | H01J 27/10 |

OTHER PUBLICATIONS

European search report from European application No. 96 830509.4, filed Oct. 4, 1996.

*Primary Examiner*—Kenneth J. Ramsey
*Attorney, Agent, or Firm*—Wolf, Greenfield & Sacks, P.C.; James H. Morris; Theodore E. Galanthay

[57] ABSTRACT

The microtips of charge emitting material, which define the cathode of the flat FED screen and face the grid of the screen, are tubular and have portions with a small radius of curvature. The microtips are obtained by forming openings in the dielectric layer separating the cathode connection layer from the grid layer, depositing a conducting material layer to cover the walls of the openings, and anisotropically etching the layer of conducting material to form inwardly-inclined surfaces with emitting tips. Subsequently, the portions of the dielectric layer surrounding the microtips are removed.

33 Claims, 3 Drawing Sheets

METHOD OF FABRICATING FLAT FED SCREENS

BACKGROUND OF THE INVENTION

1. Field of the Invention

The present invention relates to a method of fabricating flat FED (Field Emission Display) screens, and to a flat screen obtained thereby.

2. Discussion of the Related Art

As is known, the continual trend towards portable electronic equipment, such as laptop computers, personal organizers, pocket TVs, and electronic games, has brought about an enormous demand for small monochromatic or color screens of reduced depth, light weight and low dissipation. As requirements in terms of size and depth cannot be met using traditional cathode tubes, various techniques are currently being studied. In addition to LCD (Liquid Crystal Display) technology, one technology for the particular application in question is the FED technique, which affords the advantages of low dissipation, same color quality as CRTs, and visibility from any angle.

The FED technique (object, for example, of U.S. Pat. Nos. 3,665,241; 3,755,704; 3,812,559; 5,064,369 in the name of C. A. Spindt, and 3,875,442 in the name of K. Wasa et al.) is similar to the conventional CRT technique, in that light is emitted by exciting phosphors deposited on a glass screen by vacuum-accelerated electron bombardment. The main difference between the two techniques lies in the method of generating and controlling the electron beam. Whereas the conventional CRT technique employs a single cathode (or cathode per color), and the electron beam is controlled by electric fields to scan the whole screen, the FED technique employs a number of cathodes comprising microtips, each controlled by a grid, arranged parallel to and at a small distance from the screen, and the screen is scanned by sequentially exciting the microtips by an appropriate combination of grid and cathode voltages.

The cathode connections forming the columns of a matrix comprise a first low-resistivity conducting layer in the form of strips. Over the first conducting layer, and isolated electrically by a dielectric layer, a second conducting layer forming the grid of the system is provided in the form of parallel strips, perpendicular to the former and forming the rows of the matrix. The second conducting layer (grid) and the dielectric layer comprise openings extending up to the first conducting layer and accommodating microtips electrically contacting the first conducting layer.

Electron emission occurs through the microtips, which are roughly conical to exploit intensification of the electric field at the tips and so reduce the barrier between the tip material (e.g. metal) and the vacuum. As electron emission, however, substantially depends on the small radius of curvature of the emitter, efficient emission is theoretically also possible using prism-or double-cone-shaped electrodes as referred to in literature.

Methods of forming the cathode and microtips are described, for example, in the above Spindt patents and in U.S. Pat. Nos. 4,857,161; 4,940,916 and 5,194,780. More specifically, the method described in U.S. Pat. No. 4,857,161 comprises the following steps:

1. the first conducting layer (cathode) is deposited on an insulating substrate (glass);
2. the first conducting layer is masked and etched to form the columns of the matrix (cathode connections);
3. the dielectric layer is deposited;

4. the second conducting layer (grid) is deposited;
5. in the second conducting layer and the dielectric layer, circular openings of 1.2–1.5 $\mu$m in diameter and extending up to the first conducting layer are defined by masking;
6. over the structure so formed, a layer of nickel is deposited by high angle sputtering to prevent the nickel from entering the openings;
7. a metal (e.g. molybdenum) is then deposited by sputtering. The metal, at the openings, directly contacts the first conducting layer to form the tips. This step is performed by vertical or almost vertical sputtering, and the shielding effect of the walls of the openings and the nickel layer causes the deposited metal, at the bottom of the openings, to assume a conical shape with the tip roughly level with the grid electrode;
8. the nickel layer over the second conducting layer is removed by electrochemical etching to lift off the metal deposited over the grid without damaging the conical tips formed in the openings;
9. peripheral portions of the second conducting layer and of the dielectric layer are etched to free the ends of the cathode connections;
10. the second conducting layer is masked and etched to form the rows of the matrix (grid connections);
11. a coating of conducting material operating as an anode is deposited on a second glass substrate; a cathodoluminescent layer is deposited; and the second substrate is placed over the grid, with spacers arranged randomly between the cathodoluminescent layer and the grid connections.

The above method presents the following drawbacks. High-angle nickel deposition in step 6 is extremely difficult on account of the considerable size (about 27×36 cm) of the substrates of flat screens of the type in question, the need to ensure even deposition over the entire substrate, and the fact that the substrate is rotated during deposition to ensure isotropic coverage.

As such, the above step often utilizes specially designed equipment, which is complex, bulky and expensive.

SUMMARY OF THE INVENTION

It is an object of the present invention to provide a fabrication method enabling formation of the microtips using common microelectronic techniques and facilities and therefore at much lower cost, which provides for greater reliability of the results achievable.

According to an embodiment of the present invention, there are provided a method of fabricating flat FED screens, and a flat screen obtained thereby.

In practice, according to at least one embodiment of the invention, tubular microtips featuring portions with a small radius of curvature are obtained by forming openings in the dielectric layer, depositing a layer of conducting material covering the walls of the openings, and anisotropically etching the layer of conducting material to remove it, among other places, from the upper edge of the portion covering the walls, and so form tubular microtips with a tapered upper edge. Subsequently, the dielectric layer about the microtips is etched selectively.

BRIEF DESCRIPTION OF THE DRAWINGS

Several embodiments of the present invention will be described by way of example with reference to the accompanying drawings, in which.

DETAILED DESCRIPTION

Figure 1:
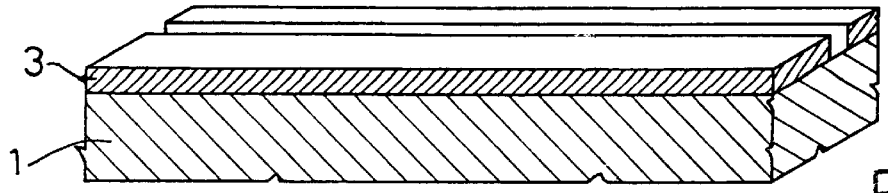
FIG. 1 illustrates a cross section of a wafer of semiconductor material at a first stage of fabrication, in which a first conducting layer is formed over an insulating layer.

With reference to FIG. 1, a first conducting layer 3 (e.g. of chromium, molybdenum, aluminum, niobium, tungsten, tungsten silicide, titanium silicide, doped amorphous or monocrystalline silicon) is deposited on a substrate 1 of insulating material (e.g. ceramic or glass). The first conducting layer 3 is then masked and etched to form the columns of the matrix (cathode connections) and obtain the structure shown in FIG. 1.

Figure 2:
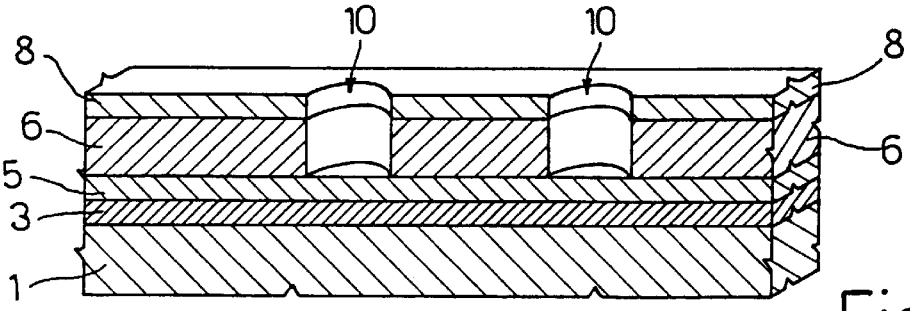
FIG. 2 shows a cross section of the wafer of FIG. 1, after openings have been formed in a second conducting layer.

Subsequently, a high-resistivity layer 5, e.g. comprising one or more layers of doped silicon, is deposited over layer 3 to limit and better distribute the current in the microtips. A dielectric (e.g. silicon oxide) layer 6 is then deposited to insulate the cathode from the grid conductor. A second conducting layer 8 (e.g. of the same material as first conducting layer 3) is deposited to act as a grid electrode, and, by masking and subsequent etching, openings 10 are defined in second conducting layer 8 and in dielectric layer 6 to form vertical-walled (e.g. circular, 0.8–1.5 $\mu$m diameter) wells extending up to high-resistivity layer 5, as shown in FIG. 2.

Figure 3:
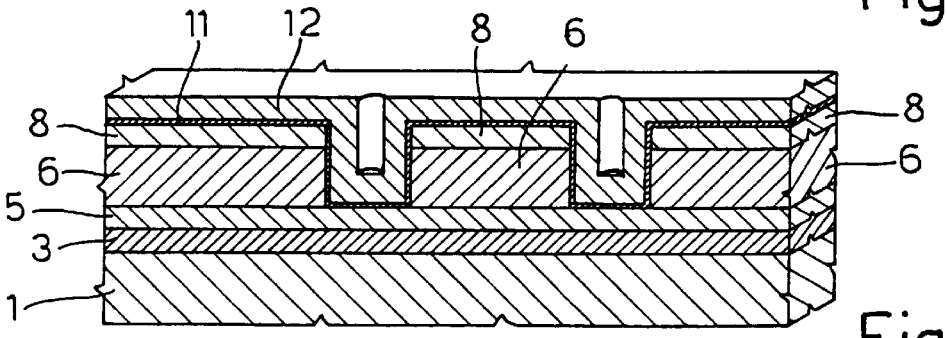
FIG. 3 illustrates a cross section of the wafer of FIGS. 1–2, on which a third conducting layer has been formed.

Subsequently, a conducting layer 12 for eventually forming the microtips is deposited, for example, by CVD (Chemical Vapor Deposition). Conducting layer 12 is advantageously of metal, preferably tungsten, which may easily be deposited by CVD from WF6, H2 and SiH4 at temperatures of around 400–500° C., therefore compatibly even with glass substrates. In at least one embodiment, after forming openings 10 and before depositing conducting layer 12, a thin layer of titanium/titanium-nitride 11 (shown only in FIG. 3 for the sake of simplicity) is preferably deposited by sputtering or CVD to assist deposition and adhesion of conducting layer 12. Alternatively, monocrystalline or amorphous silicon may be used for conducting layer 12. The total thickness of conducting layer 12 (including layer 11, if provided) preferably ranges between 400 and 800 nm, and must be roughly less than half the diameter of openings 10. CVD ensures fairly even coverage of the walls and bottom of circular openings 10. The FIG. 3 structure is thus obtained.

Subsequently, conducting layer 12 is etched to form the microtips. More specifically, an anisotropic RIE (Reactive Ion Etching) step may be performed, e.g. if conducting layer 12 is made of tungsten, in a mixture of SF6, Ar and O2 to remove all the tungsten from the flat surface of the grid electrode (Layer 8) and from the bottom of openings 10. By forming the cathode (first conducting layer 3 and resistive layer 5) and the grid electrode (second conducting layer 8) from doped amorphous silicon and conducting layer 12 from tungsten or, in general, materials with a different sensitivity to etching, conducting layer 12 may be etched selectively without damaging layers 3, 5 and 8.

As conducting layer 12 is thicker on the walls of openings 10, etching leaves a residue of layer 12 on the walls to form a cylindrical structure with an inward-tapering upper edge, while layer 12 is removed, or almost removed, from the bottom of the openings. In general, the amount of tungsten remaining at the bottom of the openings depends on the ratio between the thickness deposited and the diameter of the opening, and on the amount of etching performed. Given the deposition and etching conditions, the upper edge of the cylindrical structure assumes a high-angle profile forming, with the outer wall of the cylindrical structure, a portion with a small radius of curvature (tip) suitable for emission.

Figure 4:
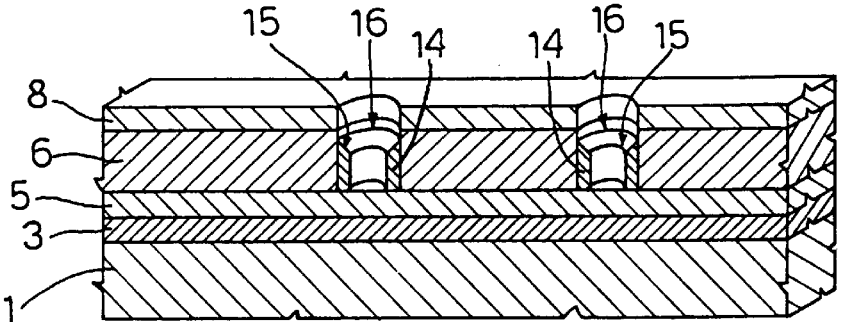
FIG. 4 is a cross-sectional view of the wafer of FIGS. 1–3, after microtips of the FED have been formed.

Advantageously, etching may be continued to achieve a certain amount of over etching, e.g. equal to 20–30% of the basic etching time, both to ensure complete removal of any tungsten residue from second conducting layer 8 and from the bottom of openings 10, and to lower the edge of the cylindrical structure below the level of the grid conductor (second conducting layer 8). This therefore gives the structure shown in FIG. 4, in which the cylindrical structures obtained are indicated at 14, the tapered edge below the level of second conducting layer 12 is indicated at 15, and the portion with the small radius of curvature and constituting the emitting surface is indicated at 16.

Figure 5:
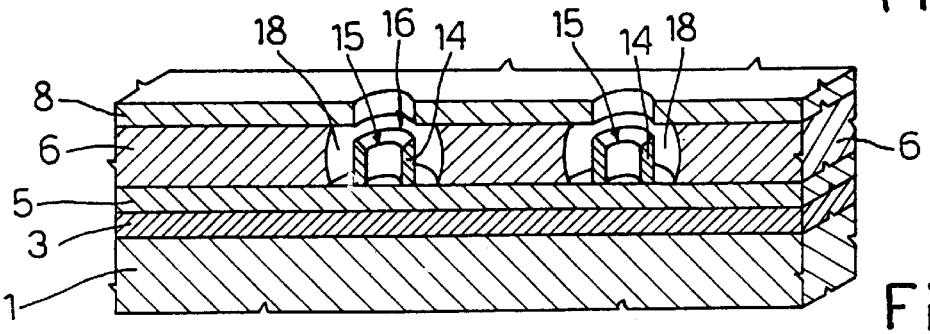
FIG. 5 shows a cross section of the wafer of FIGS. 1–4 after isotropic etching has been performed.
Figure 6:
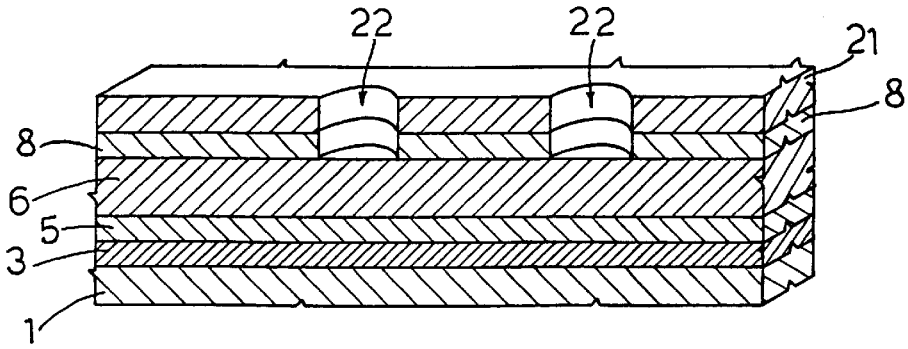
FIG. 6 illustrates a cross section of a wafer of semiconductor material in which first and second conducting layers have been formed and etching performed.
Figure 7:
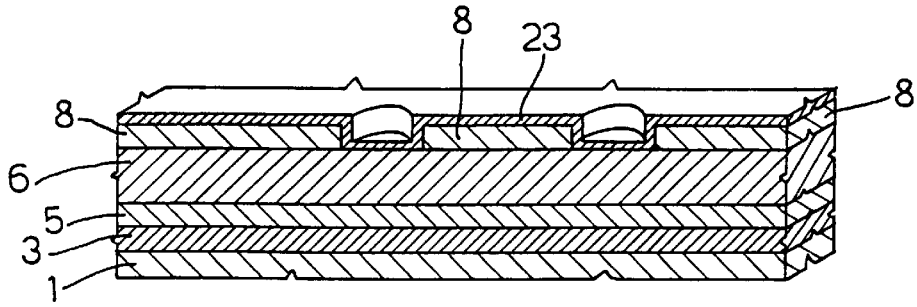
FIG. 7 shows the cross section of the wafer of FIG. 6 after a spacing layer has been added.

Subsequently, the portions of dielectric layer 6 surrounding cylindrical structures 14 may be removed by isotropic etching. For example, if layer 6 is of silicon oxide, etching may be performed in a diluted HF solution. Alternatively, isotropic (e.g. indirect plasma) etching may be performed to obtain the FIG. 5 structure, which shows cavities 18 formed by isotropic etching in dielectric layer 6. This step is useful for safely eliminating any problems of surface conduction between cylindrical structures 14 (microtips) and second conducting layer 8 (cathode). Fabrication continues with the known steps for forming the grid connections, by masking and etching second conducting layer 8 to form the outer contact areas of the cathode, and to form the anode and luminescent structures.

FIGS. 6–13 show a second embodiment, which provides for good control of the distance between the upper emitting edge of the microtips and the grid, thus reducing the voltage required to control the screen.

In the second embodiment, as already described, first conducting layer 3 is deposited. Etching is then performed to define the columns of the matrix, and high-resistivity layer 5, dielectric layer 6 and second conducting layer 8 are deposited. At this point, a resist mask 21 (FIG. 6) is deposited, and first openings 22 are formed extending only in second conducting layer 8. To this end, selective anisotropic reactive ion etching may be performed on the material of layer 8—which is easily done if, for example, second conducting layer 8 is of amorphous silicon and dielectric layer 6 of silicon oxide—to obtain the structure shown in FIG. 6.

After removing resist mask 21, a spacing layer 23 is deposited, the preferably dielectric material of which is so selected as to permit selective etching with respect to the material of both second conducting layer 8 (grid conductor) and underlying dielectric layer 6. For example, spacing layer 23 may be made of silicon nitride deposited by CVD, possibly with the assistance of plasma (PECVD) to reduce the deposition temperature. The thickness of spacing layer 23 depends on the diameter of circular openings 22, and may be roughly 200–400 nm, to give the structure shown in FIG. 7.

Figure 8:
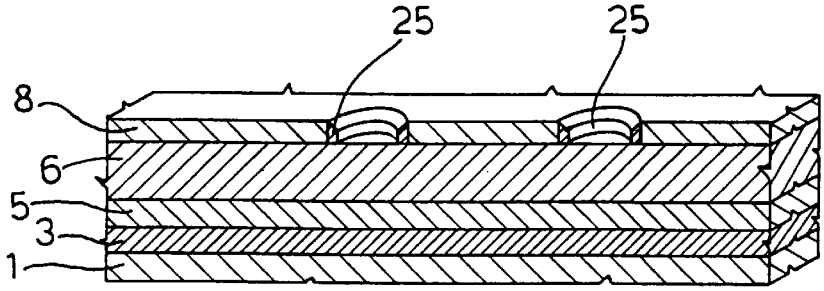
FIG. 8 is a cross-sectional view of the wafer of FIGS. 6–7 after the spacing layer has been etched.

Spacing layer 23 is then anisotropically etched, for example by RIE, up to second conducting layer 8 and, in openings 22, up to dielectric layer 6 to form spacers 25 on the walls of openings 22 (FIG. 8). If the etching of spacing layer 23 poses selectivity problems as regards both the materials of layers 8 and 6, a thin protective layer of silicon oxide (not shown) may be deposited prior to depositing mask 21 for forming openings 22.

Figure 9:
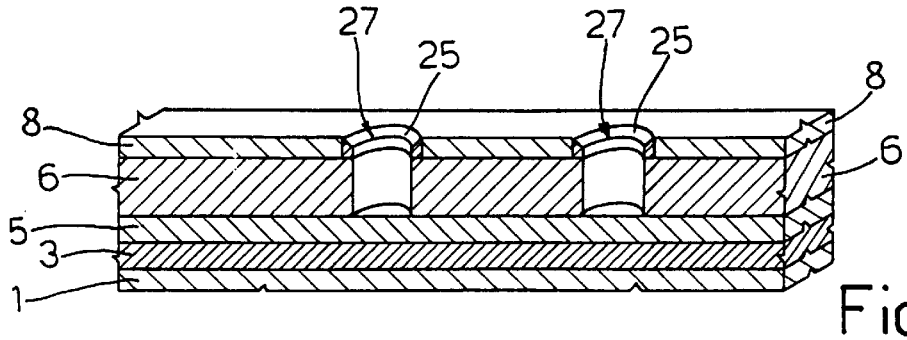
FIG. 9 shows a cross section of the wafer of FIGS. 6–8, in which openings have been formed in a dielectric layer.
Figure 10:
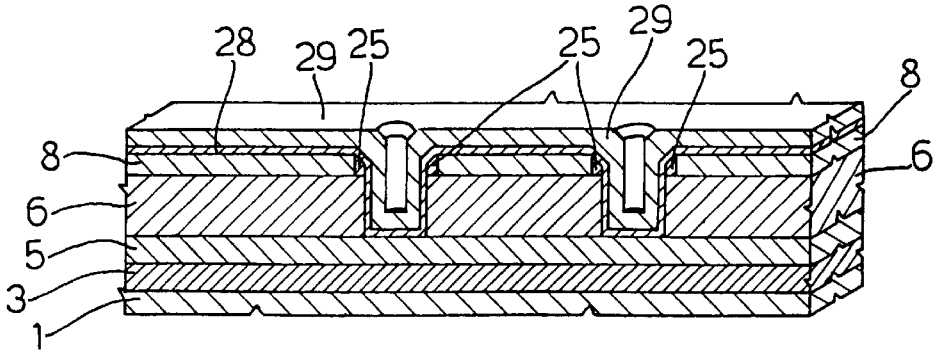
FIG. 10 is a cross-sectional view of the wafer of FIGS. 6–9 after a titanium layer has been added.
Figure 11:
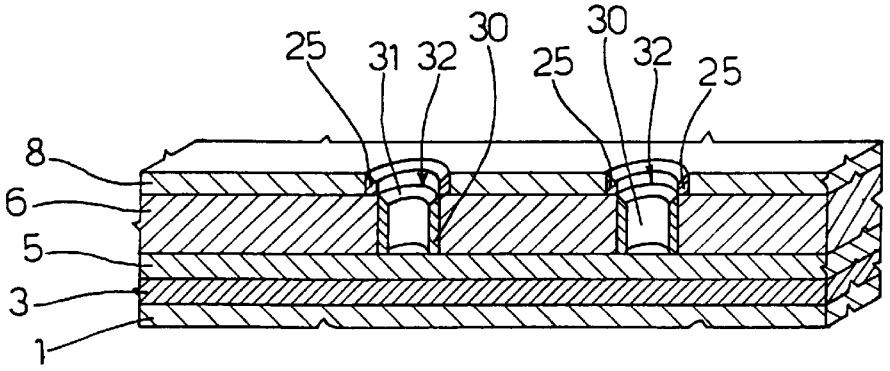
FIG. 11 illustrates a cross section of the wafer of FIGS. 6–10, in which a tapered edge has been formed on microtips.

Using the second conducting layer and spacers 25 as shields, dielectric layer 6 at openings 22 is then anisotropically etched, for example by RIE, up to high-resistivity layer 5 to form openings 27 (FIG. 9). This is then followed by the steps for forming the microtips, as described with reference to FIGS. 3 and 4. More specifically, a titanium/titanium nitride layer 28 (shown only in FIG. 10 for the sake of simplicity) is preferably first deposited, and then a conducting layer 29 (e.g. of tungsten, FIG. 10).

Subsequently, layers 28 and 29 may be anisotropically etched by RIE to remove them from the surface of second conducting layer 8 and from the bottom of openings 27. In this case, however, in view of the presence of spacers 25, etching time is affected by the removal time of layers 28, 29 from the surface of second conducting layer 8. This results in the FIG. 11 structure in which the microtips (cylindrical structures 30) show a tapered edge 31 with a portion 32 with a small radius of curvature, as in the first embodiment.

Figure 12:
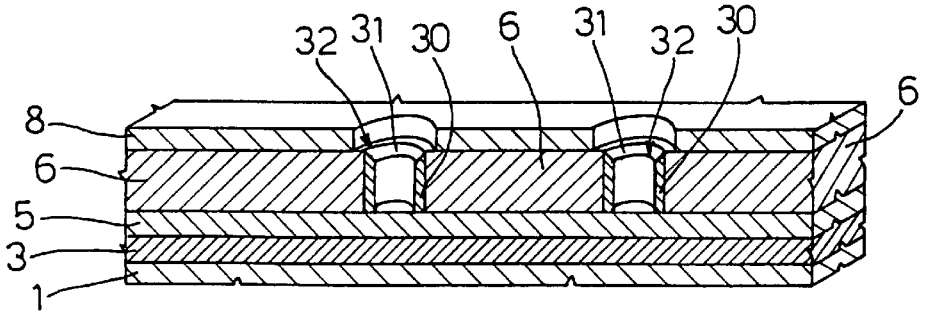
FIG. 12 is a cross-sectional view of the wafer of FIGS. 6–11 after spacers have been removed.
Figure 13:
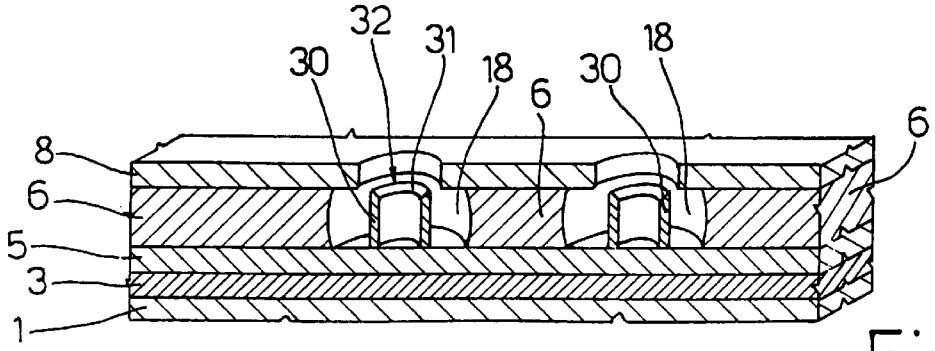
FIG. 13 shows a cross section of the wafer of FIGS. 6–12 after cavities have been formed in the dielectric area.

Spacers 25 may then be removed by anisotropic etching, e.g. in a solution of hot phosphoric acid or in indirect plasma (FIG. 12). As described with reference to FIG. 5, portions of dielectric layer 6 surrounding cylindrical structures 30 may be removed by isotropic etching to obtain cavities 18 (FIG. 13). Second conducting layer 8 is masked and etched to form the rows of the matrix (grid connections), and the final operations performed to obtain the screen.

There are several advantages of the embodiments described herein. First, they provide for forming cathode microtips using known techniques and standard microelectronic facilities, and hence at lower cost as compared with techniques so far proposed for FED screens. Moreover, using known techniques ensures a high degree of controllability and reliability of the method and results. The steps also give good results in the case of large-size screens. The emission efficiency of the resulting screen is good, due to the extensive high-angle emission surface of the microtips, which facilitates electron emission. The embodiments described are also fairly insensitive to the diameter of the openings or the thickness of the deposited layers, and, especially in the embodiment of FIGS. 6–13, provides for accurately controlling the distance between the grid and the microtips, thus reducing the voltages required to control the screen and providing for more uniform emission.

Clearly, changes may be made to the embodiments as described and illustrated herein without, however, departing from the scope of the present invention. In particular, materials other than those described may advantageously be used. For example, an organic material (polyamide) may be used as a dielectric and etched in oxygen plasma. The conducting layers (cathode and grid) may be made of different material from the microtips (e.g. the conducting layers of tungsten, tungsten silicide, chromium or niobium, the microtips of amorphous silicon) or of the same material (e.g. doped amorphous silicon), using a protective layer such as silicon oxide for the second conductor, and selectively covering the microtips with a layer of metal, such as tungsten. Moreover, the two conducting layers may be made of different materials, e.g. selected from those indicated.

Having thus described at least one illustrative embodiment of the invention, various alterations, modifications and improvements will readily occur to those skilled in the art Such alterations, modifications and improvements are intended to be within the spirit and scope of the invention. Accordingly, the foregoing description is by way of example only as defined in the following claims and the equivalents thereto.

What is claimed is:

1. A method of fabricating a flat FED screen, comprising the steps of:

forming a first conducting layer;

forming an insulating layer over the first conducting layer;

forming a second conducting layer over the insulating layer;

forming openings having walls in the second conducting layer and in the insulating layer;

covering the walls of the openings with a charge emitting material; and anisotropically etching portions of the charge emitting material;

wherein the charge emitting material includes tungsten.

2. The method of claim 1, further comprising a step of removing regions of the insulating layer surrounding the portions of charge emitting material.

3. The method of claim 2, wherein the step of removing includes isotopically etching the insulating layer selectively with respect to the first and second conducting layer and the portions of charge emitting material.

4. The method of claim 1, wherein:

the step of covering includes forming a conducting material layer over the insulating layer and in the openings; and the step of anisotropically etching includes removing portions of the conducting material layer from the surface of the second conducting layer, from the bottom of the openings, and partly from an upper edge of the portions of charge emitting material to form an upper surface of the portions of charge emitting material which is inclined in relation to the walls of the openings, and portions with a small radius of curvature.

5. The method of claim 4, wherein the step of forming a conducting material layer includes depositing a chemical vapor.

6. The method of claim 4, wherein the conducting material that forms the conducting material layer is selected from the group comprising tungsten, doped monocrystalline silicon and doped amorphous silicon.

7. The method of claim 4, further comprising a step of depositing an adhesion layer prior to the step of forming a conducting material layer.

8. The method of claim 4, wherein the step of anisotropically etching comprises an over-etching step that reduces the height of the portions of charge emitting material.

9. The method of claim 1, wherein the first and second conducting layer are formed from a material selected from the group comprising chromium, molybdenum, aluminum, niobium, tungsten, tungsten silicide, titanium silicide, and doped amorphous and monocrystalline silicon.

10. A method of fabricating a flat FED screen, comprising the steps of:

forming a first conducting layer;

forming an insulating layer over the first conducting layer;

forming a second conducting layer over the insulating layer;

forming openings having walls in the second conducting layer and in the insulating layer;

covering the walls of the openings with a charge emitting material;

anisotropically etching portions of the charge emitting material;

wherein:

the step of covering includes forming a conducting material layer over the insulating layer and in the openings;

the step of anisotropically etching includes removing portions of the conducting material layer from the surface of the second conducting layer, from the bottom of the openings, and partly from an upper edge of the portions of charge emitting material to form an upper surface of the portions of charge emitting material which is inclined in relation to the walls of the openings, and portions with small radius of curvature;

a step of depositing an adhesion layer precedes the step of forming a conducting material layer; and the conducting material includes tungsten and the adhesion layer includes titanium/titanium nitride.

11. A method of fabricating a flat FED screen, comprising the steps of:

forming a first conducting layer;

forming an insulating layer over the first conducting layer;

forming a second conducting layer over the insulating layer;

forming openings having walls in the second conducting layer and in the insulating layer;

covering the walls of the openings with a charge emitting material;

anisotropically etching portions of the charge emitting material;

wherein the step of forming openings includes the steps of:

forming first cavities in the second conducting layer, the first cavities defining lateral walls;

forming spacers surrounding the lateral walls of the first cavities; and forming second cavities masked by the spacers in the insulating layer.

12. The method of claim 11, wherein the step of forming spacers includes the steps of:

forming a spacing layer over the second conducting layer and in the first cavities; and anisotropically etching the spacing layer.

13. The method of claim 12, wherein the spacing layer includes nitride.

14. The method of claim 11, further comprising a step of removing the spacers following the step of anisotropically etching the spacing layer.

15. A method of fabricating a flat FED screen, comprising the steps of:

forming a first conducting layer of a first material;

forming an insulating layer over the first conducting layer;

forming a second conducting layer of a second material over the insulating layer;

forming openings having walls and a bottom in the second conducting layer and in the insulating layer;

depositing a layer of charge emitting material different from the first and second materials on the second conducting layer and on the walls and bottom of the openings;

anisotropically etching portions of the charge emitting material layer to form emitting structures; and isotropically etching the insulating layer under the second conducting layer and around the emitting structures.

16. The method of claim 15, wherein the emitting structures extend between the first and the second conducting layers.

17. A method for forming a display element, comprising the steps of:

forming a first conductive layer over a substrate;

forming an insulating layer over the first conductive layer;

forming a second conductive layer over the insulating layer;

forming a hole in the second conductive layer and the insulating layer;

depositing a layer of conductive material into the hole; and removing a portion of the conductive material deposited into the hole.

18. The method of claim 17, wherein:

the step of depositing includes depositing a portion of the layer of conductive material over a top surface of the second conductive layer; and the step of removing includes removing the portion of the layer of conductive material deposited over the top surface of the second conductive layer.

19. The method of claim 17, wherein:

the step of depositing includes depositing a portion of the layer of conductive material onto a wall defining the hole and a portion of the layer of conductive material onto a bottom surface defining the hole; and the step of removing includes removing the portion of the layer of conductive material deposited onto the bottom surface defining the hole.

20. The method of claim 17, wherein the step of depositing includes depositing a portion of the layer of conductive material onto a wall defining the hole without filling an entirety of the hole.

21. The method of claim 17, wherein the step of removing includes anisotropically etching the portion of the charge emitting material.

22. The method of claim 17, wherein the step of removing includes forming a tubular shaped emitter of the conductive material deposited into the hole.

23. The method of claim 22, wherein the step of removing further includes forming a tapered edge on the tubular shaped emitter.

24. The method of claim 22, wherein the step of removing further includes removing a top portion of the tubular shaped emitter.

25. The method of claim 17, wherein the step of removing includes leaving a second portion of the conductive material deposited into the hole within the hole, the method further comprising a step of removing a portion of the second layer of conductive material that surrounds the second portion of the conductive material.

26. The method of claim 17, further comprising a step of depositing an adhesion layer prior to the step of depositing the layer of conductive material.

27. A method for forming a display element, comprising the steps of:

forming a first conductive layer over a substrate;

forming an insulating layer over the first conductive layer;

forming a second conductive layer over the insulating layer;

forming a hole in the second conductive layer and the insulating layer;

depositing a layer of conductive material into the hole;

removing a portion of the conductive material deposited into the hole; and depositing an adhesion layer prior to the step of depositing the layer of conductive material;

wherein the step of depositing the layer of conductive material includes depositing tungsten and the step of depositing the adhesion layer includes depositing one of titanium and titanium nitride.

28. The method of claim 17, wherein the step of forming the hole in the second conductive layer includes forming a spacer about a top edge of the hole.

29. The method of claim 28, wherein the step of forming a spacer includes the steps of:

forming a first hole in the second conductive layer that does not penetrate through the insulating layer;

forming a spacing layer over the second conductive layer and in the hole formed in the second conductive layer; and removing a portion of the spacing layer over a surface of the second conductive layer; and removing a portion of the spacing layer on a bottom of the hole, so that a ring of spacer material remains.

30. The method of claim 29, wherein the step of forming the hole in the second conductive layer includes forming a second hole, aligned with the first hole, that penetrates through the insulating layer.

31. The method of claim 28, wherein the step of forming the spacer includes depositing nitride.

32. The method of claim 28, further comprising a step of removing the spacer following the step of removing.

33. The method of claim 17, wherein the step of depositing includes depositing at least one of tungsten, doped monocrystalline silicon, and doped amorphous silicon.

* * * * *